US011261635B2

(12) United States Patent
Barbon et al.

(10) Patent No.: US 11,261,635 B2
(45) **Date of Patent: *Mar. 1, 2022**

(54) DOOR CLOSER POWER ADJUSTMENT

(71) Applicant: Schlage Lock Company LLC, Carmel, IN (US)

(72) Inventors: Mitchell T. Barbon, Indianapolis, IN (US); Adithya G. Shetty, Bangalore (IN); Paul Koeske, Fishers, IN (US); David V. Toloday, Martinsville, IN (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/922,599

(22) Filed: Jul. 7, 2020

(65) Prior Publication Data

US 2021/0095509 A1 Apr. 1, 2021

Related U.S. Application Data

(63) Continuation of application No. 16/271,092, filed on Feb. 8, 2019, now Pat. No. 10,704,310.

(51) Int. Cl.
*E05F 1/10* (2006.01)

(52) U.S. Cl.
CPC ..... *E05F 1/105* (2013.01); *E05Y 2201/11* (2013.01); *E05Y 2201/474* (2013.01);
(Continued)

(58) Field of Classification Search
CPC . E05F 1/1025; E05F 1/04; E05F 1/105; E05F 1/1041; E05F 1/1008; E05F 3/10;
(Continued)

(56) References Cited

U.S. PATENT DOCUMENTS 1,989,908 A 2/1935 Bohnsack et al.
2,767,681 A 10/1956 Pontius
(Continued)

FOREIGN PATENT DOCUMENTS

DE 3344680 A1 6/1985
DE 102011077990 B4 12/2016
(Continued)

OTHER PUBLICATIONS

International Search Report; International Searching Authority; International Application No. PCT/US2020/017474; dated Aug. 11, 2020; 4 pages.
(Continued)

*Primary Examiner* — Chuck Y Mah
(74) *Attorney, Agent, or Firm* — Taft Stettinius & Hollister LLP

(57) ABSTRACT

An exemplary door closer has an adjustable size and includes a rotatable member operable to adjust the size and an indicator mechanism configured to indicate the current size. The indicator mechanism includes a cover mounted to a housing of the door closer and a dial rotatably mounted to the cover. The dial is engaged with the rotatable member such that the dial rotates in response to rotation of the rotatable member. The cover includes an indicating region, and the dial includes a display surface including indicia relating to the sizes of the door closer. The display surface is non-perpendicular to the rotational axis of the rotatable member. When the door closer has been adjusted to a particular size, indicia relating to the particular size are indicated by the indicating region.

20 Claims, 5 Drawing Sheets

(52) U.S. Cl.
CPC ... *E05Y 2201/492* (2013.01); *E05Y 2400/818* (2013.01); *E05Y 2900/132* (2013.01)

(58) Field of Classification Search
CPC ... E05F 3/12; E05F 3/104; E05F 3/102; E05F 3/22; E05F 3/221; E05F 3/223; E05F 3/227; E05Y 2201/618; E05Y 2201/716; E05Y 2201/722; E05Y 2201/11; E05Y 2201/474; E05Y 2201/492; E05Y 2900/132; E05Y 2400/818; Y10T 16/577; Y10T 16/2804; Y10T 16/285; Y10T 16/293; Y10T 16/585; Y10T 16/299; Y10T 16/286; Y10T 16/27
See application file for complete search history.

(56) References Cited

U.S. PATENT DOCUMENTS 3,534,773 A * 10/1970 Dewberry ..... F16K 37/0016 137/553
3,708,826 A 1/1973 Larson
3,911,527 A 10/1975 Lasier
3,934,307 A 1/1976 Lasier et al.
4,378,612 A 4/1983 Beers
4,387,482 A 6/1983 Maublanc
4,590,639 A 5/1986 Fritsche et al.
4,686,739 A 8/1987 Fritsche et al.
4,783,882 A 11/1988 Frolov
4,785,493 A * 11/1988 Tillmann ..... E05F 3/104 16/53
4,793,023 A 12/1988 Simpson et al.
4,847,946 A 7/1989 Nam et al.
5,666,692 A 9/1997 Toledo
5,687,507 A 11/1997 Beran
5,709,009 A 1/1998 Lasson et al.
6,282,750 B1 9/2001 Bishop et al.
6,871,381 B1 3/2005 Luca
8,732,905 B2 5/2014 Bell
8,779,713 B2 * 7/2014 Burris ..... E05F 15/70 318/466
9,695,620 B2 7/2017 Zasowski et al.
2004/0074145 A1 4/2004 Homberg
2004/0205930 A1 * 10/2004 Huang ..... E05F 3/00 16/64
2011/0191981 A1 8/2011 Bell
2011/0197391 A1 8/2011 Yu et al.
2011/0252598 A1 10/2011 Burris et al.
2016/0097230 A1 4/2016 Zasowski et al.
2016/0273257 A1 9/2016 Hickman
2019/0249784 A1 * 8/2019 Komatsuzaki ..... F16K 15/1825

FOREIGN PATENT DOCUMENTS

EP 0292743 A1 11/1988
GB 2180294 A 3/1987
JP 2008274583 A 11/2008

OTHER PUBLICATIONS

Written Opinion of the International Searching Authority, International Searching Authority; International Application No. PCT/US2020/017474; dated Aug. 11, 2020; 8 pages.

* cited by examiner

DOOR CLOSER POWER ADJUSTMENT

This application is a continuation of U.S. patent application Ser. No. 16/271,092 filed Feb. 8, 2019 and issued as U.S. Pat. No. 10,704,310, the contents of which are incorporated herein by reference in their entirety.

TECHNICAL FIELD

The present disclosure generally relates to adjustable closers, and more particularly but not exclusively relates to adjustable door closers.

BACKGROUND

Door closers are typically installed to doors to provide a closing force that biases the door to a closed position. The strength of the closing force corresponds to the "size" of the door closer, which is typically measured on a scale of one to six. Certain existing door closers include mechanisms by which the closing force can be adjusted to adjust the size of the door closer. While certain existing closers include visual indicators that indicate the strength of the closing force, many such indicators suffer from certain drawbacks, such as those related to visibility of the indicator. For these reasons among others, there remains a need for further improvements in this technological field.

SUMMARY

An exemplary door closer has an adjustable size and includes a rotatable member operable to adjust the size and an indicator mechanism configured to indicate the current size. The indicator mechanism includes a cover mounted to a housing of the door closer and a dial rotatably mounted to the cover. The dial is engaged with the rotatable member such that the dial rotates in response to rotation of the rotatable member. The cover includes an indicating region, and the dial includes a display surface including indicia relating to the sizes of the door closer. The display surface is non-perpendicular to the rotational axis of the rotatable member. When the door closer has been adjusted to a particular size, indicia relating to the particular size are indicated by the indicating region. Further embodiments, forms, features, and aspects of the present application shall become apparent from the description and figures provided herewith.

DETAILED DESCRIPTION OF ILLUSTRATIVE EMBODIMENTS

Figure 1:
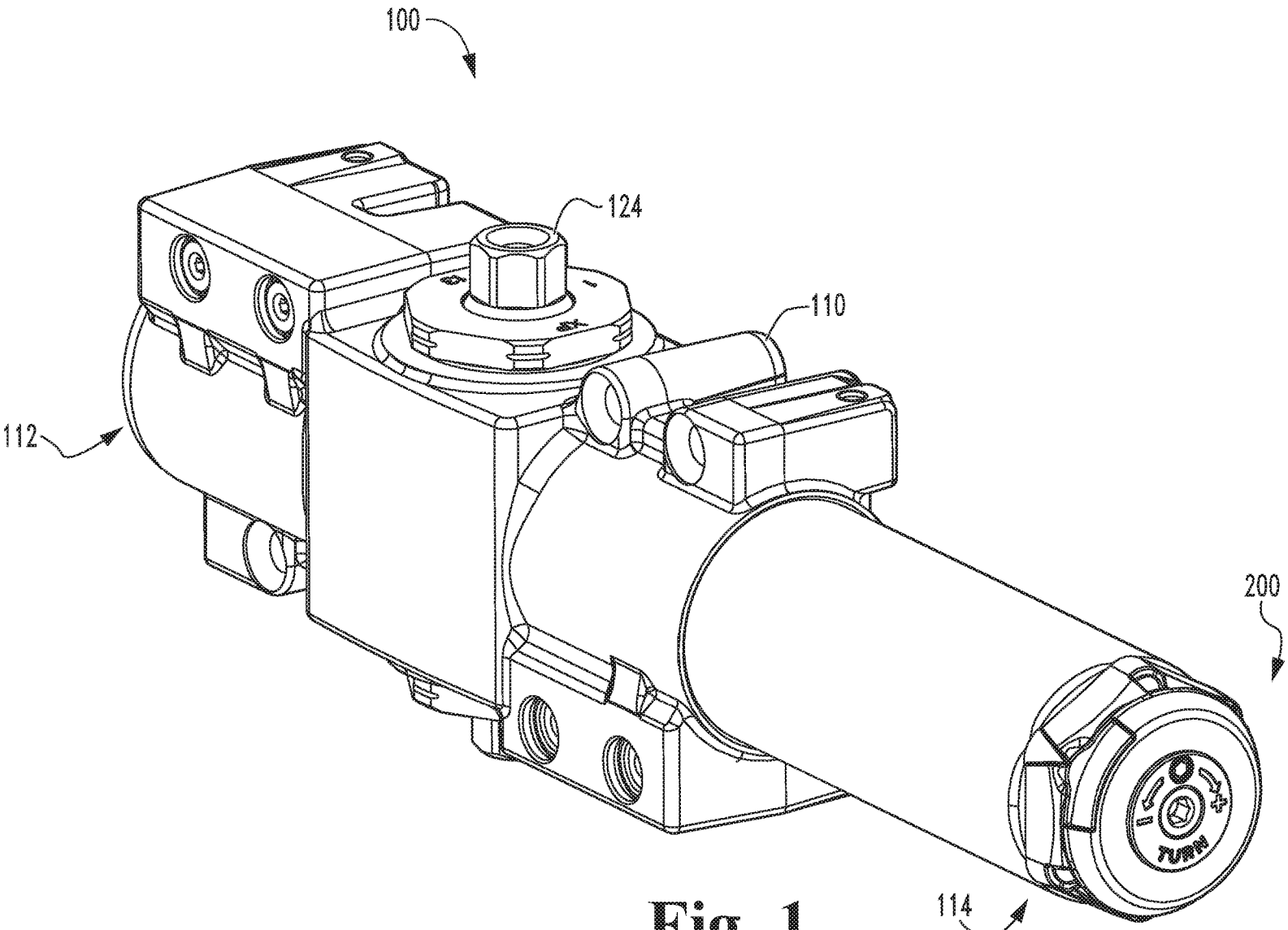
FIG. 1 is a perspective view of a door closer including an indicator mechanism according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

Figure 2:
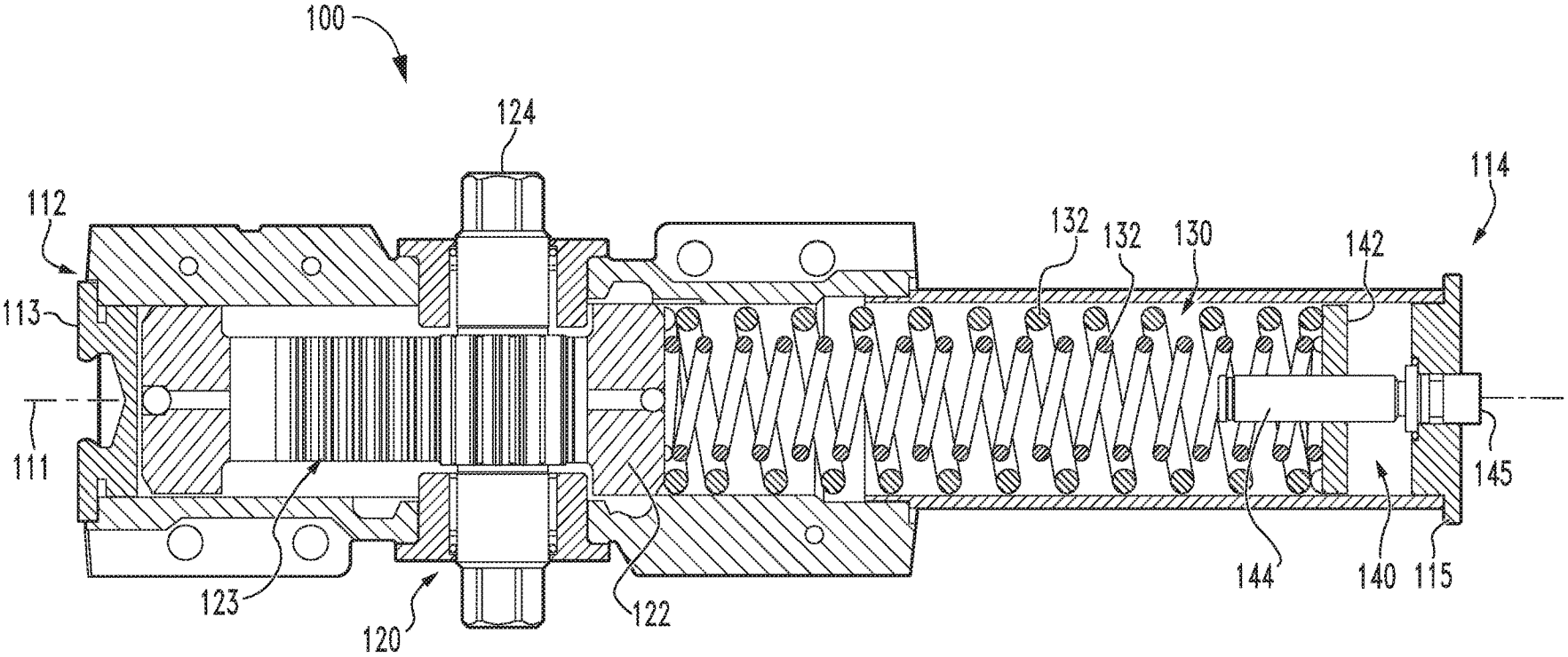
FIG. 2 is a cross-sectional illustration of the door closer illustrated.

With reference to FIGS. 1 and 2, illustrated therein is a door closer 100 according to certain embodiments. The door closer 100 includes a housing 110, a rack and pinion assembly 120 mounted in the housing 110, a spring assembly 130 engaged with the rack and pinion assembly 120, a force adjustment mechanism 140 operable to adjust the biasing force provided by the spring assembly 130, and an indicator mechanism 200 according to certain embodiments. As described herein, the size of the door closer 100 can be adjusted by manipulating the force adjustment mechanism 140, and the indicator mechanism 200 is configured to display indicia related to the size of the door closer 100.

The housing 110 extends along a longitudinal axis 111 between a first end 112 and an opposite second end 114. The first end 112 includes a first end cap 113, and the second end 114 includes a second end cap 115. As described herein, the indicator mechanism 200 is mounted to the housing 110 adjacent the second end cap 115. In certain forms, the end cap 115 may be a separate piece that is screwed into second end, while in other embodiments the end cap 115 may be integrally formed with the housing 110.

The rack and pinion assembly 120 includes a piston 122 having a rack 123 defined thereon, and a pinion 124 engaged with the rack 123 such that linear movement of the piston 122 is correlated with rotation of the pinion 124. A door control arm is connected to the pinion 124 such that opening of the door causes rotation of the pinion 124 in a door-opening direction, thereby causing linear movement of the piston 122 in a corresponding opening direction (to the right in FIG. 2). Conversely, closing of the door causes rotation of the pinion 124 in a door-closing direction, thereby causing linear movement of the piston 124 in a corresponding closing direction (to the left in FIG. 2).

The spring assembly 130 includes one or more springs 132, each of which has a first end engaged with the piston 122 and a second end engaged with an anchor plate 142 of the force adjustment mechanism 140 such that the springs 132 are captured between the piston 122 and the anchor plate 142. While two springs 132 are illustrated, it is also contemplated that the spring assembly 130 may include more or fewer springs 132. Movement of the piston 122 in the opening direction compresses the springs 132, thereby storing mechanical energy in the springs 132. As a result, the springs 132 exert a closing force on the piston 122, thereby urging the pinion 124 in the closing direction, which is opposite the opening direction. When the door becomes free to return to its closed position, the springs 132 release the stored mechanical energy by expanding, thereby driving the piston 122 in the closing direction. As a result, the rack 123 drives the pinion 124 to rotate in a door-closing direction opposite the door-opening direction, thereby causing the door control arm to return the door toward its closed position.

The force adjustment mechanism 140 includes the anchor plate 142, and further includes an adjustment screw 144 that is rotatably mounted to the second end cap 115 such that a head 145 of the adjustment screw 144 is accessible from outside the housing 110. The adjustment screw 144 is engaged with the anchor plate 142 such that rotation of the screw 144 in opposite directions linearly drives the anchor plate 142 along the longitudinal axis 111 of the housing 110, thereby adjusting the amount by which the springs 132 are preloaded. As will be appreciated, the closing force exerted by the spring assembly 130 depends in part upon the amount of preloading applied to the springs 132, which in turn depends upon the position of the anchor plate 142 within the housing 110. Thus, the closing force provided by the closer 100 can be adjusted by rotating the adjustment screw 144 to drive the anchor plate 142 back and forth within the housing 110. As described herein, the indicator mechanism 200 is configured to provide a visual indication relating to the amount by which the springs 132 are preloaded.

Figure 3:
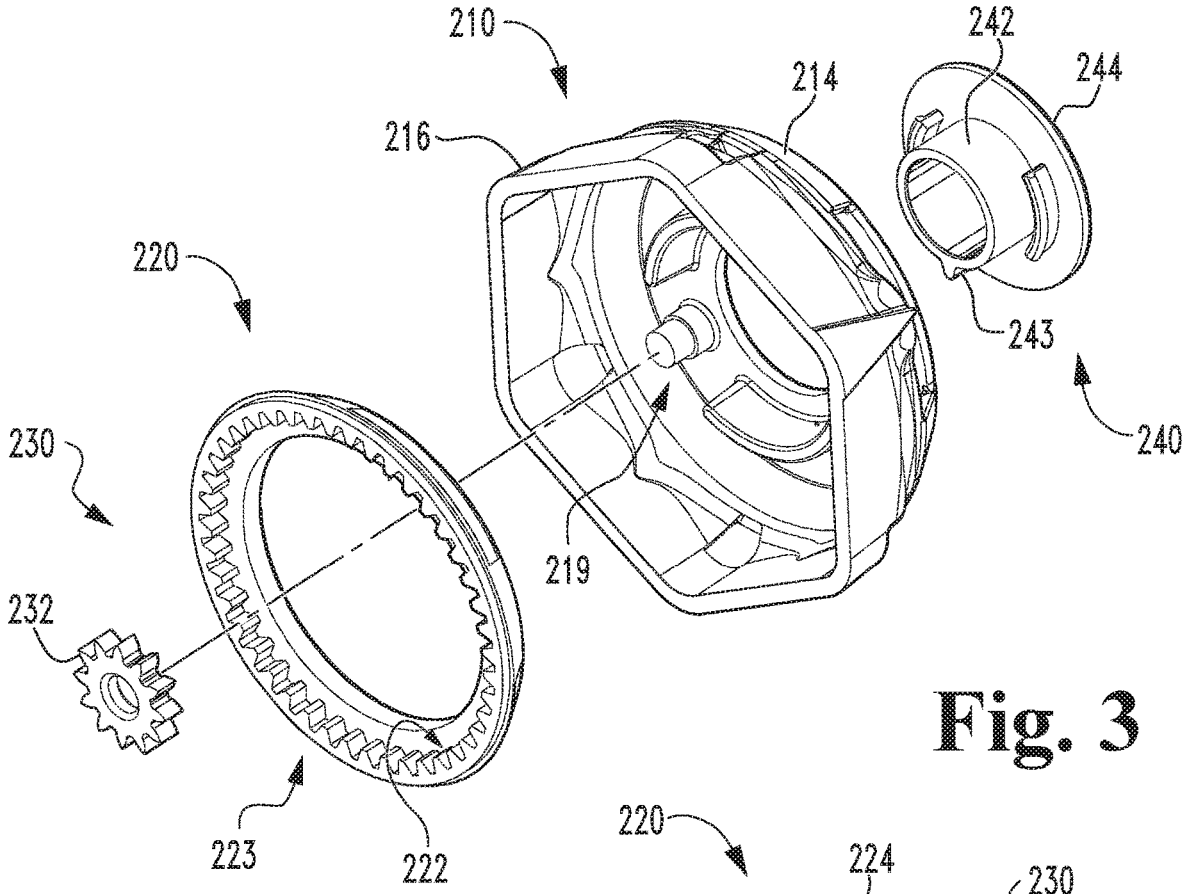
FIGS. 3 and 4 are exploded assembly views of the indicator mechanism.
Figure 4:
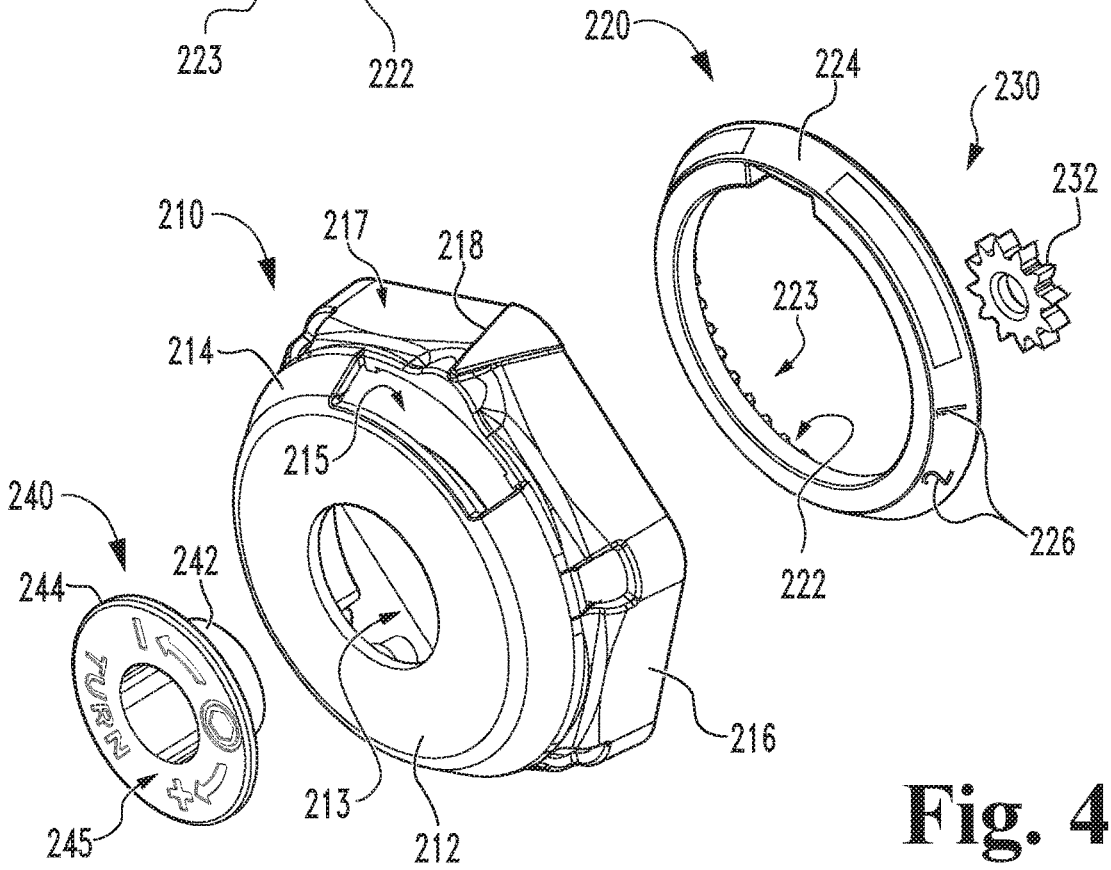

With additional reference to FIGS. 3 and 4, the indicator mechanism 200 generally includes a cover 210, a dial 220 rotatably mounted in the cover 210, a gear system 230 engaged between the dial 220 and the force adjustment mechanism 140, and a cap 240 mounted to the cover 210. As described herein, the indicator mechanism 200 selectively displays indicia relating to the preloading of the spring assembly 130 to facilitate adjustment of the closer 100 between a plurality of sizes.

Figure 5:
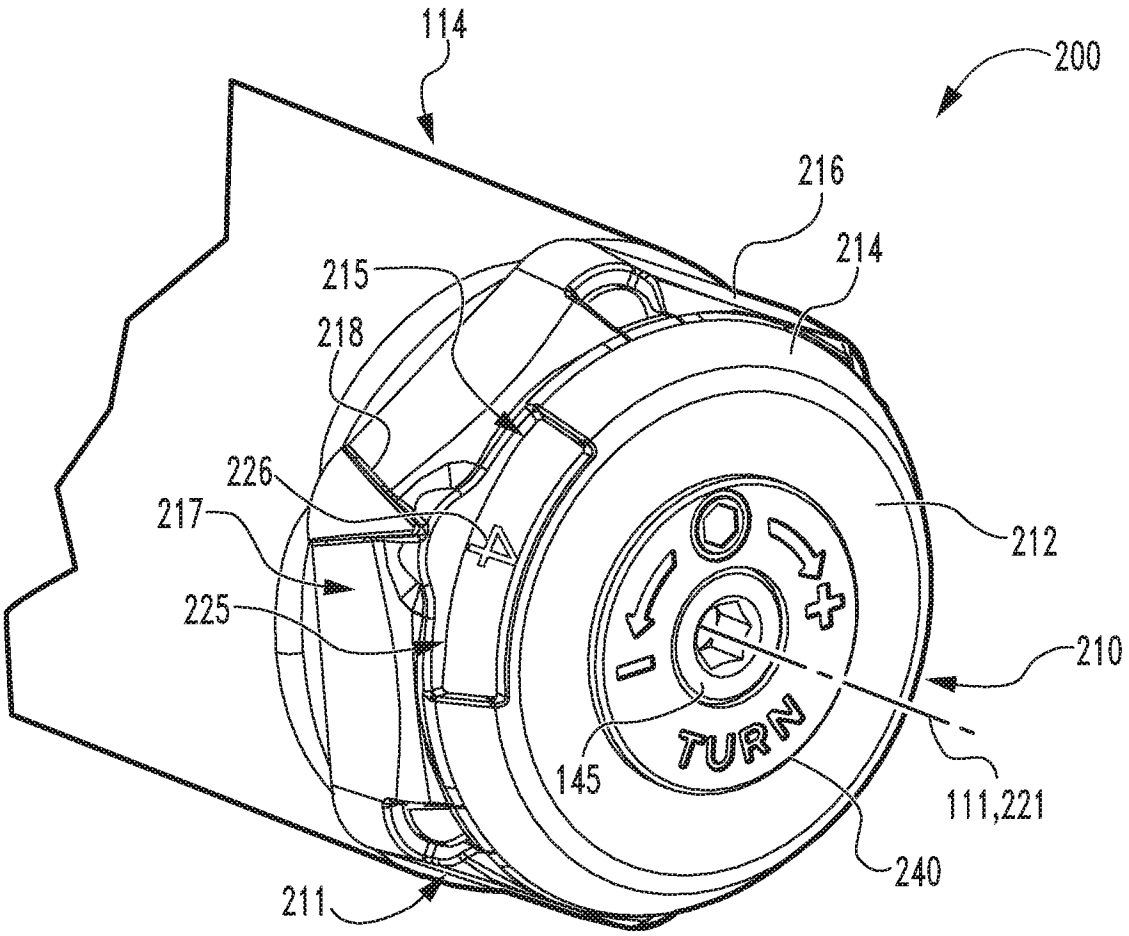
FIG. 5 is a perspective illustration of a portion of the door closer including the indicator mechanism.
Figure 6:
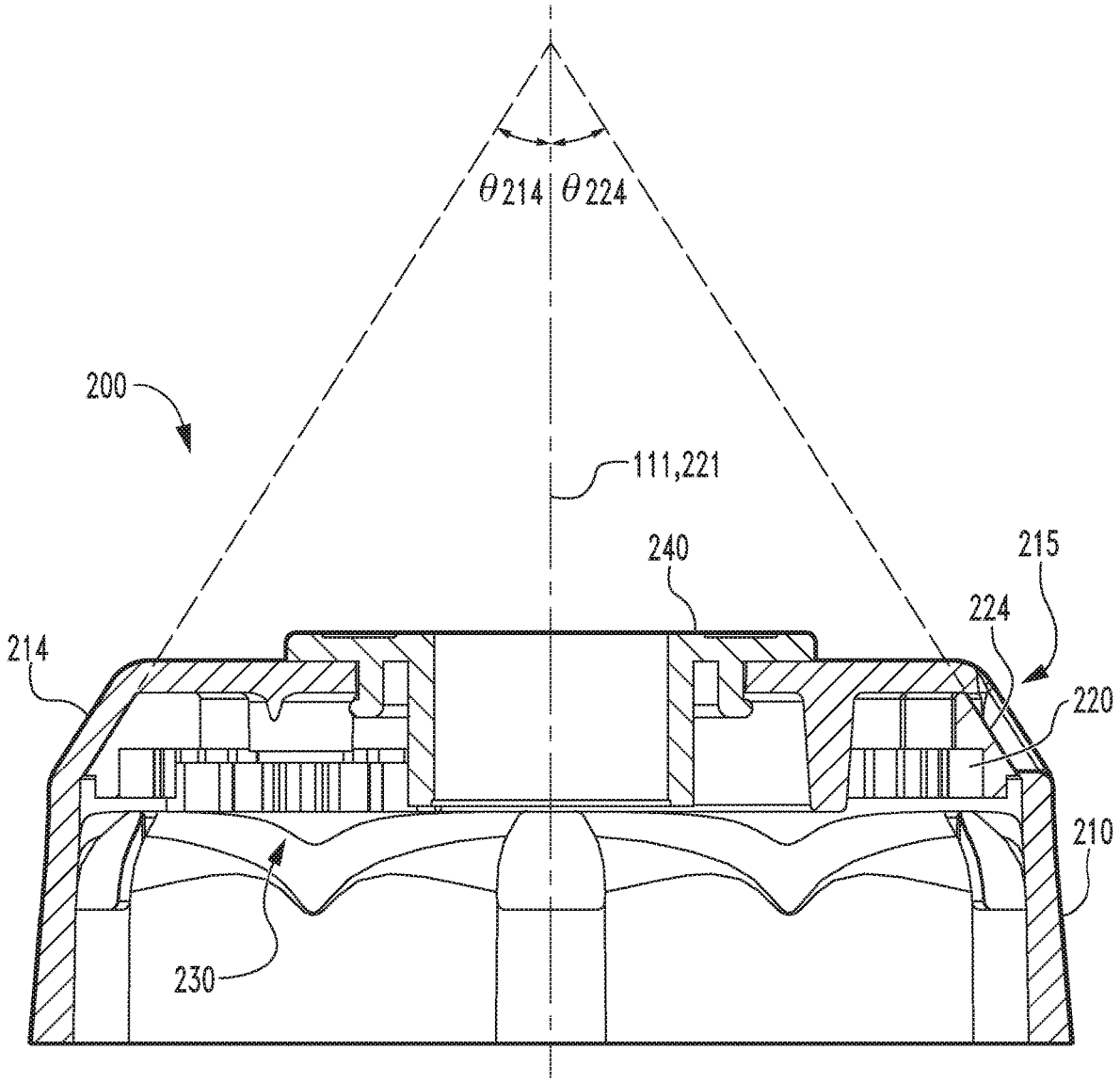
FIG. 6 is a cross-sectional illustration of the indicator mechanism.

With additional reference to FIGS. 5 and 6, the cover 210 is mounted to the second end 114 of the housing 110, and generally includes an end wall 212, a radially-outer wall 214 extending from the edges of the end wall 212, and a coupling portion 216 extending from the radially-outer wall 214. The end wall 212 includes an aperture 213 in which the cap 240 is seated. The radially-outer wall 214 is non-perpendicular to the longitudinal axis 111, and in the illustrated form defines an oblique angle θ214 relative to the longitudinal axis 111 such that the wall 214 is generally frustoconical. It is also contemplated that the wall 214 may be parallel to the longitudinal axis 111 such that the radially-outer wall 214 is substantially annular. The radially-outer wall 214 defines a window 215 through which a portion of the dial 220 is visible, thereby defining a displayed portion 225 of the dial 220. The coupling portion 216 is matingly engaged with the end cap 115 to secure the cover 210 to the second end 114 of the housing 110. For example, the coupling portion 216 may include snap fit features 211 that engage corners of the end cap 115 to releasably mount the cover 210 to the second end 114. The cover 210 may further include an indicator 218 formed adjacent the window 215 and operable to selectively align with indicia 226 on the dial 220 to indicate the current size of the closer 100. The window 215 and the indicator 218 may be considered to define an indicating region 217.

The dial 220 is mounted in the cover 210 for rotation about a rotational axis 221, which in the illustrated form is coincident with the longitudinal axis 111. The dial 220 has a generally annular inner surface 222 and a radially-outer display surface 224. The inner surface 222 faces the rotational axis 221 and is toothed to define a ring gear 223 that interfaces with the gear system 230. In certain forms, the gear system 230 may be considered to include the ring gear 223. The display surface 224 is non-perpendicular to the rotational axis 221, and in the illustrated form defines an oblique angle θ224 relative to the rotational axis 221. As a result, the display surface 224 is frustoconical, and partially defines the dial 220 as a frustoconical dial 220. The oblique angles θ214, 0224 may be substantially similar to one another such that the radial wall 214 substantially conforms to the display surface 224. While other angles are contemplated, in certain forms, the oblique angles θ214, 0224 may each be in the range of 30° to 60°. In other embodiments, the display surface 224 may be parallel to the rotational axis 221 such that the display surface 224 is annular, thereby defining the dial 220 as an annular dial.

The display surface 224 includes a displayed portion 225 (FIG. 5), which is aligned with the window 215 such that the displayed portion 225 is visible via the window 215. The display surface 224 further includes one or more indicia 226, which, as described herein, relate to the size of the closer 100, and therefore to the preloading of the spring assembly 130. As will be appreciated, rotation of the dial 220 relative to the cover 210 alters which portion of the display surface 224 is visible via the window 215, thereby altering which portion of the display surface 224 constitutes the displayed portion 225. Thus, rotating the dial 220 relative to the cover 210 alters which if any of the indicia 226 is provided within the displayed portion 225.

The gear system 230 is configured to cause rotation of the dial 220 in response to rotation of the cap 240, and in the illustrated form includes a transmission gear 232. The transmission gear 232 is mounted to a post 219 of the cover 210, and is meshed with the ring gear 223 such that rotation of the gear 232 causes a corresponding rotation of the dial 220. As described herein, the gear 232 is also operable to engage a tooth 243 formed on the cap 240. In certain forms, the gear system 230 may be considered to include the ring gear 223 and/or the tooth 243. While the illustrated gear system 230 includes one transmission gear 232, it is also contemplated that more or transmission gears may be utilized. In certain forms, the transmission gear 232 may be omitted, and the tooth 243 may be operable to directly engage the ring gear 223.

The cap 240 is rotatably mounted to the cover 210 and is rotationally coupled with the head 145 of the adjustment screw 144. In certain forms, the cap 240 may be formed of plastic, and may be press-fit to the head 145 to rotationally couple the cap 240 with the screw 144. The cap 240 includes an annular wall 242 that receives the screw head 145 and a flange 244 that is seated on the outer side of the cover 210. Protruding from the annular wall 242 is at least one gear tooth 243 operable to engage the transmission gear 232 such that rotation of the cap 240 through a full 360° rotation causes at least some rotation of the gear system 230, thereby rotating the dial 220. The flange 244 may include indicia 245 relating to the adjustment mechanism 140. For example, the indicia 245 may indicate that turning the adjustment screw 144 in a first direction increases the size of the closer 100 (i.e., by increasing the preload of the spring assembly 130) and/or that turning the adjustment screw 144 in a second direction opposite the first direction decreases the size of the closer 100 (i.e., by decreasing the preload of the spring assembly 130).

During an adjustment operation, the closer 100 begins at an initial size, and the indicia 226 relating to the initial size is displayed in the displayed portion 225 of the dial 220. For example, the initial size of the closer 100 may be the three size, and the displayed indicia 226 may be "3". In order to adjust the size, the user engages an appropriate tool (e.g., a hex key) with the head 145 of the adjustment screw 144 and rotates the adjustment screw 144 in a selected direction. For example, the user may rotate the adjustment screw 144 in the first direction to increase the size of the closer 100. Such rotation of the adjustment screw 144 drives the anchor plate 142 to further compress the spring assembly 130, thereby increasing the preloading of the spring assembly 130. Rotation of the adjustment screw 144 also causes a corresponding rotation of the cap 240, thereby causing the gear assembly 230 to rotate the dial 220.

As the dial 220 rotates, the portion of the dial 220 that is displayed as the displayed portion 225 alters. More particularly, the indicia 226 relating to the initial size of the closer 100 moves out of the displayed portion 225, and the indicia 226 relating to the new size of the closer 100 (e.g., the four size) enters the displayed portion 225. Continued rotation of the adjustment screw 144 causes the new indicia 226 to align with the indicator 218, thereby indicating that the closer 100 has been adjusted to the new size (in the illustrated example, the four size).

As should be evident from the foregoing, when the door closer 100 is of a particular size, the appropriate one of the indicia 226 is indicated by the indicating region 217. More particularly, the appropriate one of the indicia 226 is aligned with the window 215 and the indicator arrow 218 such that the indicia 226 is visible via the window 215 and the indicator arrow 218 points at the indicium 226. In certain forms, the indicating region 217 may include only one of the window 215 or the indicator arrow 218, or may include additional or alternative features not specifically described herein.

Those skilled in the art will readily appreciate that the indicator mechanism 200 described herein provides certain advantages over prior art indicator mechanisms. For example, certain existing indicator mechanisms include a dial having a display that is perpendicular to the longitudinal axis. Such perpendicular display surfaces may be more difficult to view when performing an adjusting process, which may cause the user to crane his or her neck in an uncomfortable manner when attempting to view the display surface. In contrast, the display surface 224 of the illustrated embodiment is oblique to the longitudinal axis, thereby facilitating viewing of the indicium 226 in the displayed region 225 during the adjustment process. In certain embodiments, the colors of the adjustment mechanism 200 may further increase the visibility of the displayed indicium 226. For example, the display surface 224 and the indicia 226 may be of contrasting colors.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A door closer, comprising:

a housing;

an adjustment screw rotatably mounted to the housing for rotation about a longitudinal axis to adjust a current size of the door closer; and a dial including a display surface and a plurality of indicia located on the display surface, wherein the display surface is arranged non-perpendicular to the longitudinal axis, and wherein each of the plurality of indicia relates to a corresponding potential size of the door closer; and wherein the adjustment screw is engaged with the dial such that rotation of the adjustment screw rotates the dial to thereby indicate the current size of the door closer.

2. The door closer of claim 1, further comprising an indicator, wherein the indicator is aligned with an aligned indicium of the plurality of indicia such that the aligned indicium indicates the current size of the door closer.

3. The door closer of claim 2, wherein the indicator comprises at least one of a window or an arrow.

4. The door closer of claim 2, further comprising a cover that covers a portion of the dial, and wherein the cover comprises the indicator.

5. The door closer of claim 1, further comprising a spring mounted in the housing;

wherein rotation of the adjustment screw adjusts a preloading of the spring; and wherein the current size of the door closer corresponds to the preloading of the spring.

6. The door closer of claim 1, wherein the display surface is arranged at an oblique angle relative to the longitudinal axis.

7. The door closer of claim 6, wherein the oblique angle is between 30° and 60°.

8. The door closer of claim 1, wherein the display surface is frustoconical.

9. The door closer of claim 1, further comprising a gear assembly, wherein the adjustment screw is engaged with the dial via the gear assembly.

10. An indicator mechanism for a door closer comprising a housing and an adjustment screw operable to adjust a current size of the door closer between a plurality of potential sizes, the indicator mechanism comprising:

a cover configured for mounting to the housing and including an indicator;

a dial mounted in the cover for rotation about a longitudinal axis, the dial including a display surface arranged non-perpendicular to the longitudinal axis, wherein the display surface includes a plurality of indicia, wherein each of the plurality of indicia relates to a corresponding potential size of the door closer, and wherein an aligned indicium of the plurality of indicia is aligned with the indicator to thereby indicate the current size of the door closer; and a gear assembly operable to connect the adjustment screw and the dial such that rotation of the adjustment screw rotates the dial to thereby alter which of the plurality of indicia is the aligned indicium.

11. The indicator mechanism of claim 10, wherein the indicator comprises a window through which the aligned indicium is visible.

12. The indicator mechanism of claim 11, wherein the cover further comprises a wall that obscures at least one obscured indicium of the plurality of indicia.

13. The indicator mechanism of claim 11, wherein the indicator further comprises an arrow.

14. The indicator mechanism of claim 10, wherein the indicator comprises an arrow.

15. The indicator mechanism of claim 10, wherein the display surface is frustoconical.

16. A door closer having an adjustable size, the door closer comprising:

an adjustment mechanism operable to adjust the door closer between a plurality of sizes including a first size and a second size, wherein the adjustment mechanism comprises a rotatable member operable to rotate about a longitudinal axis to adjust a current size of the door closer; and a rotatable dial including a display surface arranged non-perpendicular to the longitudinal axis, the display surface comprising a first indicium relating to the first size and a second indicium relating to the second size;

wherein the dial is engaged with the rotatable member such that the rotatable member is operable to rotate the dial;

wherein the current size of the door closer is the first size when the first indicium is aligned with an indicating region of the door closer; and wherein the current size of the door closer is the second size when the second indicium is aligned with the indicating region.

17. The door closer of claim 16, further comprising a cover defining at least a portion of the indicating region; and wherein the dial is mounted within the cover.

18. The door closer of claim 16, wherein the indicating region comprises a window through which the first indicium and the second indicium are selectively displayed.

19. The door closer of claim 16, wherein the indicating region comprises an arrow.

20. The door closer of claim 16, wherein the display surface is arranged at an oblique angle relative to the longitudinal axis.

* * * * *